US008049701B2

(12) United States Patent
Kim

(10) Patent No.: US 8,049,701 B2
(45) Date of Patent: Nov. 1, 2011

(54) PIXEL AND ORGANIC LIGHT EMITTING DISPLAY DEVICE USING THE SAME

(75) Inventor: Yang-Wan Kim, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 333 days.

(21) Appl. No.: 12/483,837

(22) Filed: Jun. 12, 2009

(65) Prior Publication Data

US 2009/0309516 A1 Dec. 17, 2009

(30) Foreign Application Priority Data

Jun. 17, 2008 (KR) ..... 10-2008-0056813

(51) Int. Cl.
*G09G 3/36* (2006.01)

(52) U.S. Cl. ..... 345/92; 345/82; 345/76; 345/90; 345/204

(58) Field of Classification Search ..... 345/76–78, 345/82–84, 87–92, 98, 102, 204, 211–214
See application file for complete search history.

(56) References Cited

U.S. PATENT DOCUMENTS

| | | | |
|---|---|---|---|
| 2004/0252089 | A1 | 12/2004 | Ono et al. |
| 2006/0097965 | A1 | 5/2006 | Deane et al. |
| 2007/0091029 | A1 | 4/2007 | Uchino et al. |

FOREIGN PATENT DOCUMENTS

| | | | |
|---|---|---|---|
| EP | 1 923 857 | A2 | 5/2008 |
| EP | 1 923 857 | A3 | 6/2008 |
| KR | 10-2005-0121379 | | 12/2005 |
| KR | 10-2006-0024869 | | 3/2006 |
| KR | 10-2006-0134405 | | 12/2006 |

OTHER PUBLICATIONS

SIPO Office action dated May 12, 2010, for corresponding Chinese Patent application 200910142448.6, with English translation, noting US Publication 2006/0097965 and EP 1923857, both previously filed in an IDS dated Nov. 9, 2009.

European Search Report dated Aug. 20, 2009, for corresponding European application 09162890.9, noting listed references in this IDS.

*Primary Examiner* — Tuyet Thi Vo

(74) *Attorney, Agent, or Firm* — Christie, Parker & Hale, LLP

(57) ABSTRACT

A pixel capable of compensating for the threshold voltage of a driving transistor, the voltage drop of a first power source and degradation of an organic light emitting diode is provided. The pixel includes an organic light emitting diode; a second transistor (e.g., a driving transistor) coupled between the first power source and the organic light emitting diode to control the current supplied to the organic light emitting diode; a third transistor coupled between a first electrode of the second transistor and the first power source; a first transistor coupled between a gate electrode of the second transistor and a data line; a first capacitor coupled between the gate electrode and the first electrode of the second transistor; a second capacitor coupled between the first electrode of the second transistor and the first power source; and a compensation circuit coupled between the organic light emitting diode and the gate electrode of the second transistor for adjusting a voltage of the gate electrode of the second transistor in accordance with degradation of the organic light emitting diode.

15 Claims, 4 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2008-0056813, filed on Jun. 17, 2008, in the Korean Intellectual Property Office, the entire content of which is incorporated herein by reference.

BACKGROUND

1. Field of the Invention

The present invention relates to a pixel and an organic light emitting display device using the same.

2. Discussion of Related Art

In recent years, there have been may attempts to develop various flat panel display devices with reduced weight and volume, as compared to cathode ray tubes. Flat panel display devices include liquid crystal display devices, field emission display devices, plasma display devices, and organic light emitting display devices, among others.

Among flat panel display devices, the organic light emitting display device displays an image by using organic light emitting diodes, which generate light by recombining electrons and holes. The organic light emitting display device has an advantage in that it has a relatively rapid response time and may also be driven with relatively low power consumption.

FIG. 1 is a circuit view showing a pixel of a conventional organic light emitting display device.

Referring to FIG. 1, the pixel 4 of the conventional organic light emitting display device includes an organic light emitting diode (OLED), and a pixel circuit 2 coupled to a data line (Dm) and a scan line (Sn) to control the organic light emitting diode (OLED).

An anode electrode of the organic light emitting diode (OLED) is coupled to the pixel circuit 2, and a cathode electrode of the organic light emitting diode (OLED) is coupled to a second power source (ELVSS). The organic light emitting diode (OLED) generates light with a luminance corresponding to an electric current supplied from the pixel circuit 2.

The pixel circuit 2 controls an amount of current supplied to the organic light emitting diode (OLED) in accordance with a data signal supplied to the data line (Dm) when a scan signal is supplied to the scan line (Sn). For this purpose, the pixel circuit 2 includes a second transistor (M2') coupled between a first power source (ELVDD) and the organic light emitting diode (OLED); a first transistor (M1') coupled between a gate electrode of the second transistor (M2') and the data line (Dm), with a gate electrode of the first transistor coupled to the scan line (Sn); and a storage capacitor (Cst) coupled between the gate electrode and a first electrode of the second transistor (M2').

The gate electrode of the first transistor (M1') is coupled to the scan line (Sn), and a first electrode of the first transistor (M1') is coupled to the data line (Dm). A second electrode of the first transistor (M1') is coupled to one terminal of the storage capacitor (Cst). Here, the first electrode of the first transistor (M1') is either a source electrode or a drain electrode, and the second electrode of the first transistor (M1') is the other of the source electrode and the drain electrode. For example, when the first electrode is a source electrode, the second electrode is a drain electrode. The first transistor (M1') is turned on when a low scan signal is supplied from the scan line (Sn), and supplies a data signal from the data line (Dm) to the storage capacitor (Cst). In this case, the storage capacitor (Cst) is charged with a voltage corresponding to the data signal.

The gate electrode of the second transistor (M2') is coupled to one terminal of the storage capacitor (Cst), and a first electrode of the second transistor (M2') is coupled to the other terminal of the storage capacitor (Cst) and the first power source (ELVDD). A second electrode of the second transistor (M2') is coupled to an anode electrode of the organic light emitting diode (OLED). The second transistor (M2') controls the amount of current in accordance with a voltage value stored in the storage capacitor (Cst), the current flowing from the first power source (ELVDD) to the second power source (ELVSS) via the organic light emitting diode (OLED). In this case, the organic light emitting diode (OLED) generates light corresponding to the amount of current supplied from the second transistor (M2').

However, the pixel 4 of the conventional organic light emitting display device has problems with displaying an image with uniform luminance. More particularly, a threshold voltage of the second transistor (M2') (e.g., driving transistor) in each of the pixels 4 is different due to manufacturing process variances. When the threshold voltages of drive transistors are set to different threshold voltage levels as described above, inaccurate luminance is generated in pixels of the organic light emitting diode (OLED) due to the different threshold voltages of the drive transistors, even though data signals corresponding to a same gray level are supplied to the pixels.

Also, the conventional organic light emitting display device has problems in that the voltage from the first power source (ELVDD) may vary from pixel to pixel due to a voltage drop of the voltage from the first power source (ELVDD), depending on the position of each pixel in the display unit. When the voltage from the first power source (ELVDD) varies according to the position of the pixels as described above, it is very difficult to display an image with uniform luminance.

Furthermore, the conventional organic light emitting display device has problems displaying images with desired luminance due to the changes in efficiency from degradation of the organic light emitting diode (OLED). That is to say, organic light emitting diodes (OLED) degrade with time, which makes it more difficult to display an image with desired luminance. In fact, the organic light emitting diode (OLED) device generates images with progressively lower luminance as the organic light emitting diodes (OLED) degrade.

SUMMARY OF THE INVENTION

Accordingly, an aspect of exemplary embodiments according to the present invention is to provide a pixel capable of compensating for the threshold voltage of the drive transistor, the voltage drop of the first power source and the degradation of the organic light emitting diode, and an organic light emitting display device using the same.

One aspect of an embodiment of the present invention provides a pixel including an organic light emitting diode; a second transistor coupled between a first power source and the organic light emitting diode for controlling an amount of current supplied from the first power source to the organic light emitting diode; a third transistor coupled between a first electrode of the second transistor and the first power source, the third transistor configured to turn off when a light emission control signal is applied to a light emission control line coupled to a gate electrode of the third transistor; a first transistor coupled between a gate electrode of the second transistor and a data line, the first transistor configured to turn on when a scan signal is applied to a scan line coupled to a gate electrode of the first transistor; a first capacitor coupled between the gate electrode and the first electrode of the second transistor; a second capacitor coupled between the first electrode of the second transistor and the first power source; and a compensation circuit coupled between the organic light emitting diode and the gate electrode of the second transistor, the compensation circuit for adjusting a voltage at the gate electrode of the second transistor in accordance with the degradation of the organic light emitting diode.

In this case, a capacitance of the second capacitor may be greater than a capacitance of the first capacitor. Also, the capacitance of the second capacitor may be 2 to 10 times the capacitance of the first capacitor. In addition, the compensation circuit may include a third capacitor having a first terminal coupled to the gate electrode of the second transistor; a fourth transistor coupled between a second terminal of the third capacitor and an anode electrode of the organic light emitting diode, the fourth transistor configured to turn on when the scan signal is applied to the scan line coupled to a gate electrode of the fourth transistor; and a fifth transistor coupled between the second terminal of the third capacitor and a reference power source, the fifth transistor configured to turn off when the light emission control signal is applied to the light emission control line coupled to a gate electrode of the fifth transistor.

Another aspect of an embodiment of the present invention provides an organic light emitting display device including a scan driver for applying scan signals to a plurality of scan lines and applying light emission control signals to a plurality of light emission control lines; a data driver for supplying a reset power voltage and applying data signals to a plurality of data lines; and a plurality of pixels arranged at crossing regions of the plurality of data lines and the plurality of scan lines, wherein each of the plurality of pixels includes an organic light emitting diode; a second transistor coupled between a first power source and the organic light emitting diode, the second transistor for controlling an amount of current supplied from the first power source to the organic light emitting diode; a third transistor coupled between a first electrode of the second transistor and the first power source, the third transistor configured to turn off when a light emission control signal is applied to a corresponding light emission control line coupled to a gate electrode of the third transistor; a first transistor coupled between a gate electrode of the second transistor and a corresponding data line, the first transistor configured to turn on when a scan signal is applied to a corresponding scan line coupled to a gate electrode of the first transistor; a first capacitor coupled between the gate electrode and the first electrode of the second transistor; a second capacitor coupled between the first electrode of the second transistor and the first power source; and a compensation circuit coupled between the organic light emitting diode and the gate electrode of the second transistor, the compensation circuit for adjusting a voltage at the gate electrode of the second transistor in accordance with degradation of the organic light emitting diode.

In this case, the scan driver may be configured to apply a light emission control signal to an $i^{th}$ light emission control line during a second portion and a third portion of a period in which a scan signal is being applied to a corresponding $i^{th}$ scan line. Also, the scan driver may be configured to stop the application of the light emission control signal to the $i^{th}$ light emission control line after the application of the scan signal to the corresponding $i^{th}$ scan line is stopped. Furthermore, the data driver may be configured to supply the reset power voltage to the plurality of data lines during a first portion and the second portion of the period, and may be configured to apply data signals to the plurality of data lines during the third portion of the period.

As described above, a pixel according to embodiments of the present invention, and an organic light emitting display device using the same, may be useful to display an image with uniform luminance by compensating for the threshold voltage of the drive transistor, the voltage drop of the first power source, and degradation of the organic light emitting diode included in each of the pixels.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EXEMPLARY EMBODIMENTS

Figure 1:
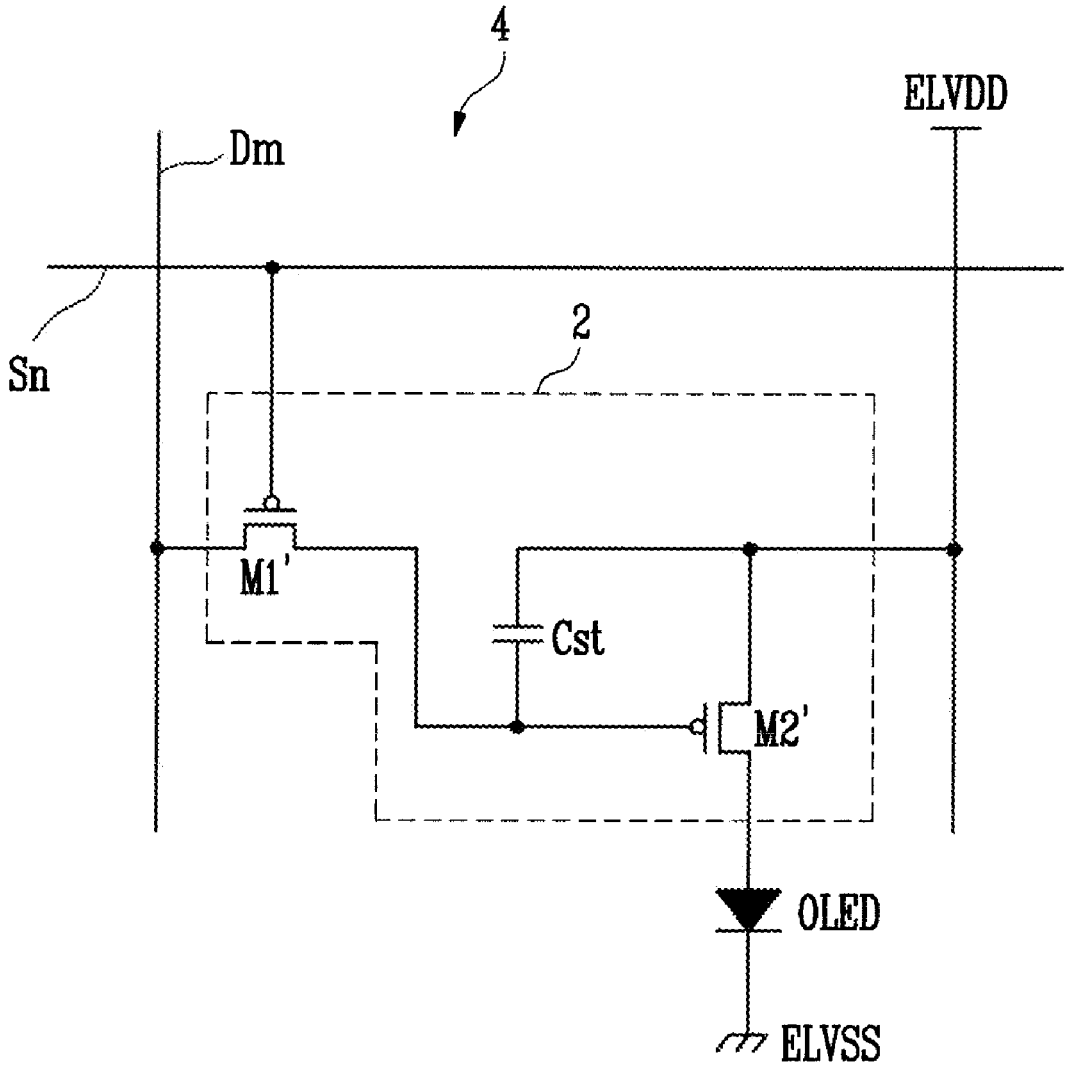
FIG. 1 is a circuit illustrating a conventional pixel.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more additional elements. Further, some of the elements that are not essential to the complete understanding of the invention are omitted for clarity. Also, like reference numerals refer to like elements throughout.

Figure 2:
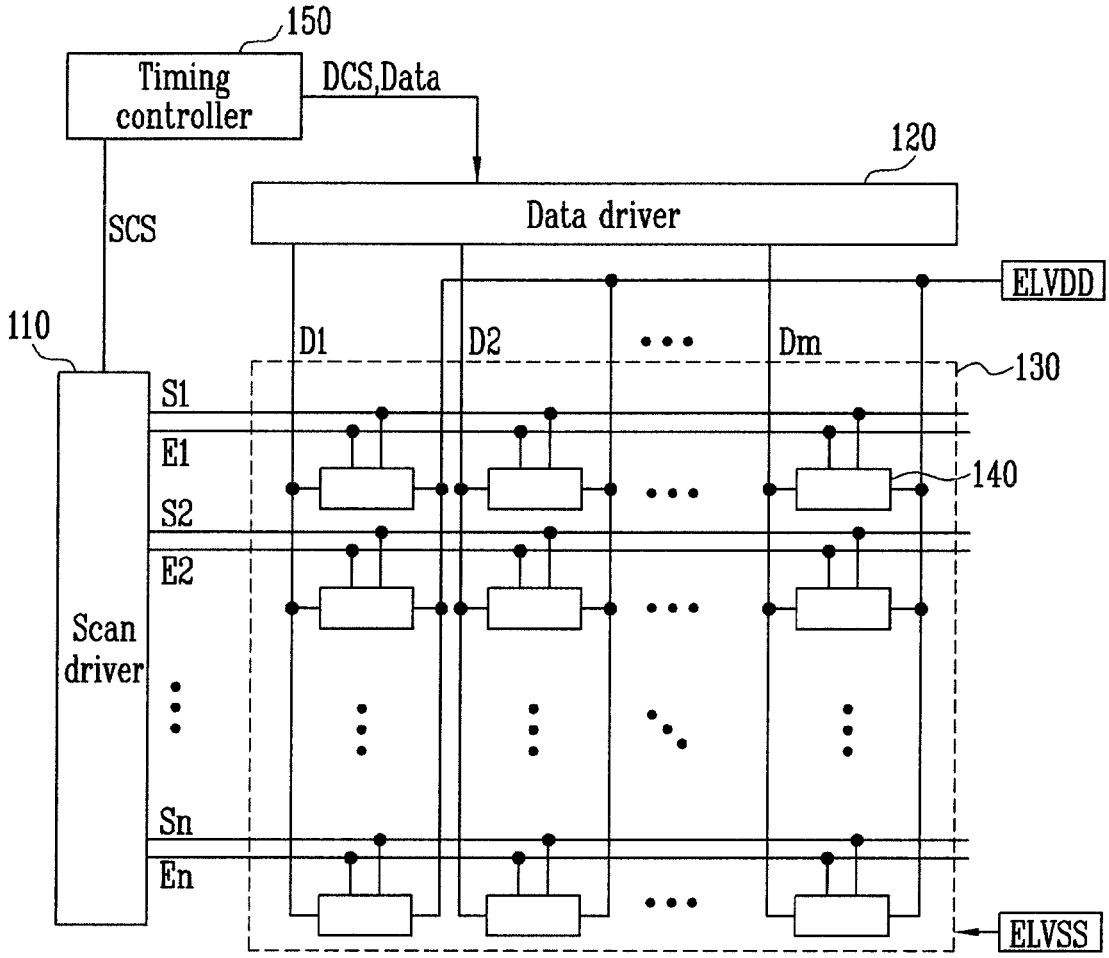
FIG. 2 is a schematic block diagram illustrating an organic light emitting display device according to one exemplary embodiment of the present invention.

FIG. 2 is a schematic block diagram illustrating an organic light emitting display device according to one exemplary embodiment of the present invention.

Referring to FIG. 2, the organic light emitting display device according to one exemplary embodiment of the present invention includes a display unit 130 including pixels 140 arranged at crossing regions of scan lines (S1 to Sn) and data lines (D1 to Dm); a scan driver 110 for driving the scan lines (S1 to Sn) and light emission control lines (E1 to En); a data driver 120 for driving the data lines (D1 to Dm); and a timing controller 150 for controlling the scan driver 110 and the data driver 120.

Figure 3:
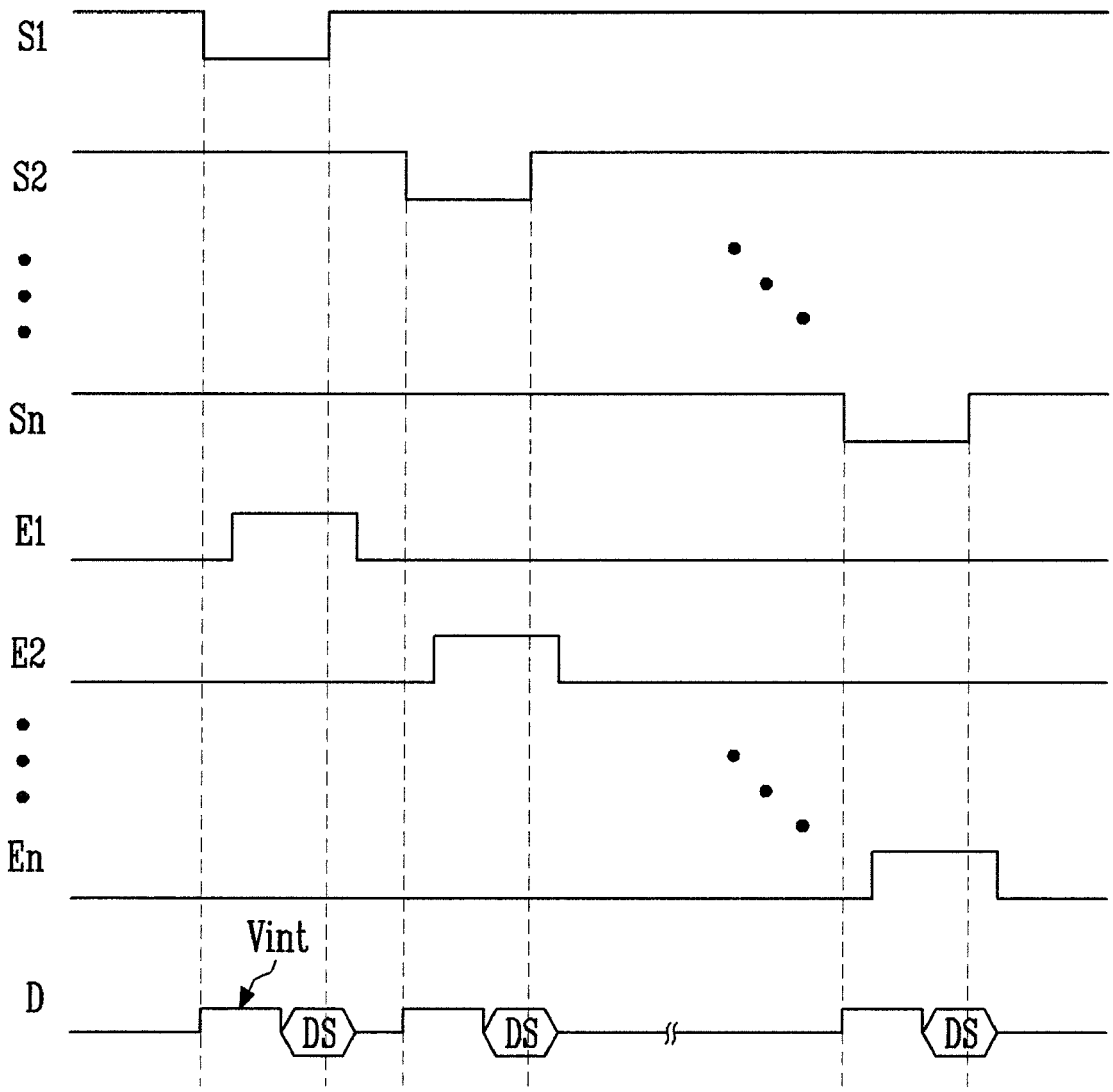
FIG. 3 is a waveform illustrating a driving waveform supplied from a scan driver and a data driver as shown in FIG. 2.

The scan driver 110 receives a scan drive control signal (SCS) from the timing controller 150, and sequentially applies scan signals to the scan lines (S1 to Sn), as shown in FIG. 3. Also, the scan driver 110 sequentially applies a light emission control signal to the light emission control lines (E1 to En). Here, a light emission control signal is applied to an $i^{th}$ light emission control line (Ei) after a scan signal is applied to a corresponding $i^{th}$ scan line (Si), and suspended after application of the scan signal to the $i^{th}$ scan line (Si) is suspended. In this embodiment, the scan signal has a LOW level voltage when it is applied, and the light emission control signal has a HIGH level voltage when it is applied. In other embodiments, the scan signal and the emission control signal may be at either high or low levels when they are applied, depending on the particular embodiment, without being limited to any particular embodiment.

The data driver 120 receives a data drive control signal (DCS) and data (Data) from the timing controller 150, generates a data signal (DS), and applies the generated data signal (DS) to the data lines (D1 to Dm). Here, the data driver 120 applies a reset power source (Vint) (e.g., the reset power source (Vint) described with respect to FIG. 3) to the data lines (D1 to Dm) during a portion of a period when a low scan signal is overlapped with a high light emission control signal from the time when the application of the high scan signal is started. Further, the data driver 120 applies a data signal (DS) to the data lines (D1 to Dm) during a remaining portion of the period when the low scan signal is overlapped with the high light emission control signal. A voltage of the reset power source (Vint) is set to a higher voltage level than that of the data signal (DS), and set to a lower voltage level than that of the first power source (ELVDD).

The timing controller 150 generates a data drive control signal (DCS) and a scan drive control signal (SCS) in accordance with externally supplied synchronization signals. The data drive control signal (DCS) generated in the timing controller 150 is supplied to the data driver 120, and the scan drive control signal (SCS) is supplied to the scan driver 110. The timing controller 150 may also supply externally supplied data (Data) to the data driver 120.

The display unit 130 receives a first power source (ELVDD) and a second power source (ELVSS) from the outside, supplying the received first power source (ELVDD) and second power source (ELVSS) to each of the pixels 140. Each of the pixels 140 receiving the first power source (ELVDD) and the second power source (ELVSS) generates light corresponding to the data signal (DS).

Figure 4:
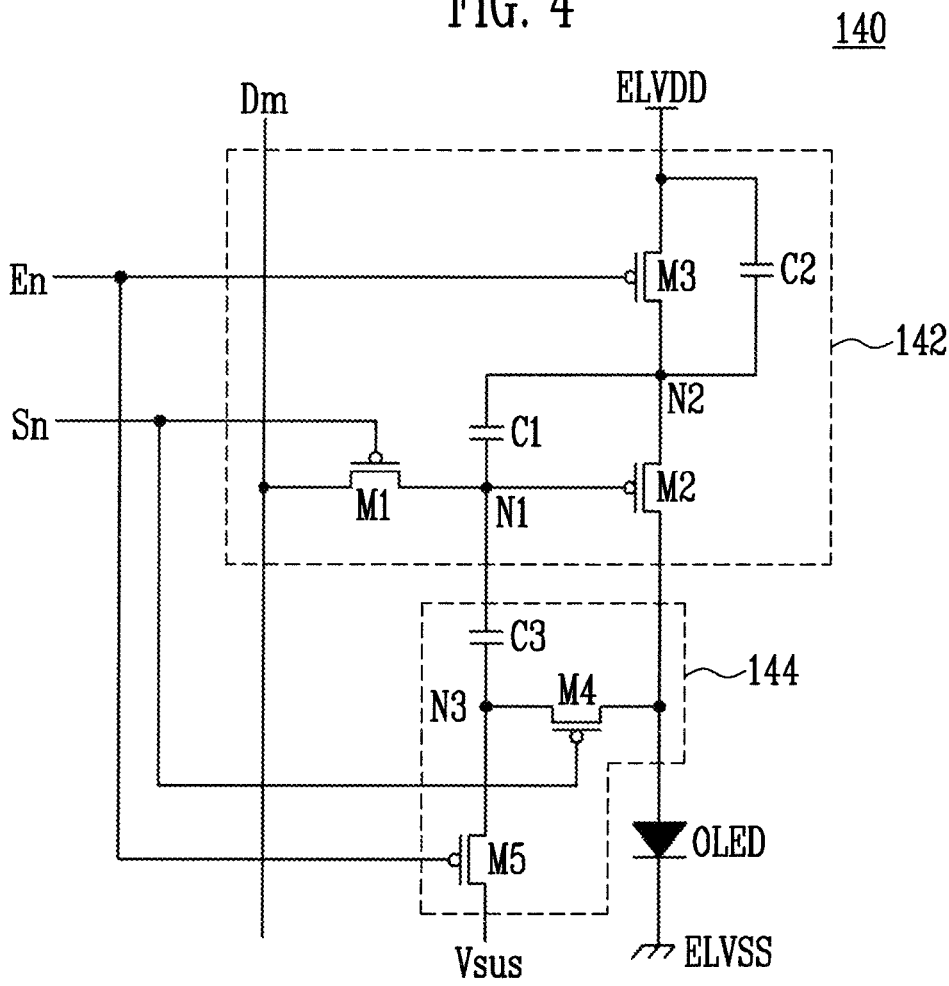
FIG. 4 is a circuit illustrating a pixel according to one exemplary embodiment of the present invention as shown in FIG. 2.

FIG. 4 is a diagram showing a pixel according to one exemplary embodiment of the present invention as shown in FIG. 2. For convenience, FIG. 4 shows a pixel coupled to an $n^{th}$ scan line (Sn) and an $m^{th}$ data line (Dm).

Referring to FIG. 4, the pixel 140 according to one exemplary embodiment of the present invention includes an organic light emitting diode (OLED); a pixel circuit 142 coupled to the data line (Dm) and the scan line (Sn) to control the amount of current supplied to the organic light emitting diode (OLED); and a compensation circuit 144 that compensates for the degradation of the organic light emitting diode (OLED).

An anode electrode of the organic light emitting diode (OLED) is coupled to the pixel circuit 142, and a cathode electrode of the organic light emitting diode (OLED) is coupled to a second power source (ELVSS). The organic light emitting diode (OLED) generates light with a luminance corresponding to the amount of current supplied from the pixel circuit 142. Here, the voltage of the second power source (ELVSS) is set to a lower voltage level than that of the first power source (ELVDD).

The pixel circuit 142 controls the amount of current supplied to the organic light emitting diode (OLED) in accordance with to the data signal applied to the data line (Dm) when a scan signal is applied to the scan line (Sn). For this purpose, the pixel circuit 142 includes first to third transistors (M1 to M3), a first capacitor (C1) and a second capacitor (C2).

A first electrode of a first transistor (M1) is coupled to the data line (Dm), and a second electrode of the first transistor (M1) is coupled to a first node (N1) (namely, a gate electrode of a second transistor (M2)). A gate electrode of the first transistor (M1) is coupled to the scan line (Sn). The first transistor (M1) is turned on when a low scan signal is applied to the scan line (Sn), and applies a reset power source or a data signal from the data line (Dm) to the first node (N1).

A first electrode of the second transistor (M2) is coupled to a second node (N2) (namely, a second electrode of a third transistor (M3)), and a second electrode of the second transistor (M2) is coupled to an anode electrode of the organic light emitting diode (OLED). A gate electrode of the second transistor (M2) is coupled to the first node (N1). The second transistor (M2) applies an electric current to the organic light emitting diode (OLED), the electric current corresponding to the voltage applied to the first node (N1).

A first electrode of the third transistor (M3) is coupled to the first power source (ELVDD), and a second electrode of the third transistor (M3) is coupled to the second node (N2). A gate electrode of the third transistor (M3) is coupled to the light emission control line (En). The third transistor (M3) is turned off when a high emission light control signal is applied to the light emission control line (En), and turned on when a low light emission control signal is applied to the light emission control line (En).

The first capacitor (C1) is coupled between the first node (N1) and the second node (N2). The first capacitor (C1) stores a voltage corresponding to the data signal and the threshold voltage of the second transistor (M2).

The second capacitor (C2) is arranged between the first power source (ELVDD) and the second node (N2). The second capacitor (C2) stably maintains a voltage of the second node (N2). For this purpose, the second capacitor (C2) has a greater capacitance than the first capacitor (C1). For example, the second capacitor (C2) may have a capacitance 2 to 10 times the capacitance of the first capacitor (C1), or more.

The compensation circuit 144 controls a voltage of the first node (N1) to compensate for degradation of the organic light emitting diode (OLED). For this purpose, the compensation circuit 144 includes a fourth transistor (M4), a fifth transistor (M5), and a third capacitor (C3).

A second electrode of the fourth transistor (M4) is coupled to an anode electrode of the organic light emitting diode (OLED), and a first electrode of the fourth transistor (M4) is coupled to the third node (N3). A gate electrode of the fourth transistor (M4) is coupled to the scan line (Sn). The fourth transistor (M4) is turned on when a low scan signal is applied to the scan line (Sn), and applies a voltage, applied to the organic light emitting diode (OLED), to the third node (N3).

A first electrode of the fifth transistor (M5) is coupled to a reference power source (Vsus), and a second electrode of the fifth transistor (M5) is coupled to the third node (N3). A gate electrode of the fifth transistor (M5) is coupled to the light emission control line (En). The fifth transistor (M5) is turned off when a high light emission control signal is applied to the light emission control line (En), and turned on when a low light emission control signal is applied to the light emission control line (En).

A first terminal of the third capacitor (C3) is coupled to the first node (N1), and a second terminal of the third capacitor (C3) is coupled to the third node (N3). The a third capacitor (C3) adjusts the voltage of the first node (N1) in accordance with voltage changes at the third node (N3).

Figure 5:
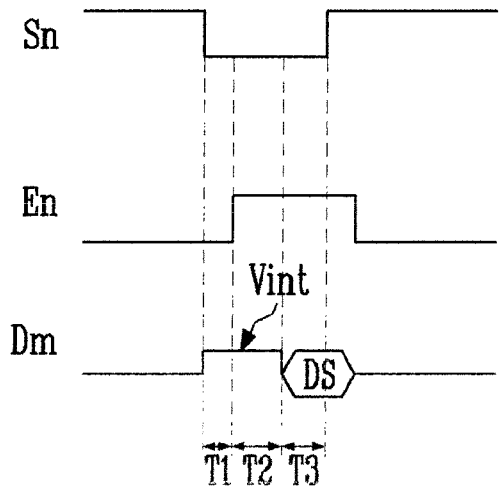
FIG. 5 is a waveform illustrating a driving waveform of the pixel as shown in FIG. 4.

FIG. 5 is a waveform illustrating a driving waveform of the pixel shown in FIG. 4.

An operation of the pixel 140 will be described in detail in connection with FIGS. 4 and 5. First, when a low scan signal is applied to the scan line (Sn), the first transistor (M1) and the fourth transistor (M4) are turned on. A reset power source (Vint) is supplied to the data line (Dm) during a first portion (T1) of the period when the scan signal is supplied to the scan line (Sn).

When the first transistor (M1) is turned on, the reset power source (Vint) supplied to the data line (Dm) is supplied to the first node (N1) via the first transistor (M1). The second node (N2) maintains a voltage of the first power source (ELVDD) since the third transistor (M3) is turned on during the first portion (T1). Here, the second transistor (M2) is turned on since a voltage of the reset power source (Vint) has a lower voltage than the first power source (ELVDD).

When the fourth transistor (M4) is turned on, the voltage applied to the organic light emitting diode (OLED) is applied to the third node (N3).

A high light emission control signal is applied to the light emission control line (En) during a second portion (T2) of the period when the low scan signal is applied to the scan line (Sn). When the high light emission control signal is applied to the light emission control line (En), the third transistor (M3) and the fifth transistor (M5) are turned off.

When the third transistor (M3) is turned off, the second transistor (M2) is consequently turned off. When the second transistor (M2) is turned off, a voltage corresponding to the threshold voltage of the second transistor (M2) (e.g., a voltage difference between the second node (N2) and the first node (N1)) is charged in the first capacitor (C1) during the second portion (T2).

When the fifth transistor (M5) is turned off, the third node (N3) and the reference power source (Vsus) are electrically isolated from each other. In this case, the third node (N3) stably receives a voltage applied to the organic light emitting diode (OLED).

A data signal (DS) is applied to the data line (Dm) during a third portion (T3) of the period in which the scan signal is supplied to the scan line (Sn). During the third period (T3), the data signal (DS) applied to the data line (Dm) is applied to the first node (N1) via the first transistor (M1). When the data signal (DS) is applied to the first node (N1), a voltage of the first node (N1) drops from the reset power source (Vint) to a voltage of the data signal (DS). In this case, the second node (N2) maintains its voltage from the second portion (T2). More particularly, the capacitance of the second capacitor (C2) is greater than the capacitance of the first capacitor (C1). Therefore, the second node (N2) maintains its voltage from the second portion (T2) even if the voltage of the first node (N1) is changed. Thus, a voltage corresponding to the threshold voltage of the second transistor (M2) and the data signal (DS) is charged in the first capacitor (C1).

Meanwhile, the threshold voltage of the organic light emitting diode (OLED) is applied to the third node (N3) during the third portion (T3). The threshold voltage of the organic light emitting diode (OLED) increases as the organic light emitting diode (OLED) degrades.

Then, the first transistor (M1) and the fourth transistor (M4) are turned off when the application of the low scan signal is stopped. When the first transistor (M1) is turned off, the first node (N1) is floated. When the fourth transistor (M4) is turned off, the organic light emitting diode (OLED) and the third node (N3) are electrically isolated from each other.

After the application of the low scan signal is stopped, the application of the high light emission control signal is also stopped. When the application of the high light emission control signal is stopped, the third transistor (M3) and the fifth transistor (M5) are turned on. When the third transistor (M3) is turned on, a voltage of the first power source (ELVDD) is supplied to the second node (N2). In this case, the voltage of the floated first node (N1) is also increased to correspond to the increase in voltage of the second node (N2). That is to say, the voltage charged in the first capacitor (C1) is maintained at the voltage of the previous portion even when the third transistor (M3) is turned on.

Also, since the first node (N1) is floated when the voltage of the first power source (ELVDD) is supplied to the second node (N2), the pixel circuit 142 compensates for the voltage drop of the voltage from the first power source (ELVDD) corresponding to the position of the pixel 140. That is to say, the voltage of the first node (N1) is increased in accordance with the increase in voltage of the second node (N2), to display an image with desired luminance regardless of the voltage drop of the voltage from the first power source (ELVDD).

When the fifth transistor (M5) is turned on, a voltage of the third node (N3) increases from the threshold voltage of the organic light emitting diode (OLED) to the reference power source (Vsus). For this purpose, a voltage of the reference power source (Vsus) is set to a higher voltage level than the threshold voltage of the organic light emitting diode (OLED). The voltage of the floated first node (N1) is also increased in accordance with increases of the voltage at the third node (N3). Then, the second transistor (M2) generates light with a luminance by supplying an electric current to the organic light emitting diode (OLED), the electric current corresponding to the voltage applied to the first node (N1).

Meanwhile, the organic light emitting diode (OLED) degrades with time. Here, the threshold voltage of the organic light emitting diode (OLED) increases as the organic light emitting diode (OLED) degrades. That is to say, when an electric current is supplied from the second transistor (M2), the voltage applied to the organic light emitting diode (OLED) increases as the organic light emitting diode (OLED) degrades.

The voltage of the organic light emitting diode (OLED) applied to the third node (N3) thus—increases as the organic light emitting diode (OLED) degrades. Therefore, a voltage charged in the third capacitor (C3) becomes lower as the organic light emitting diode (OLED) degrades.

When the voltage charged in the third capacitor (C3) becomes lower, the increase in voltage of the first node (N1) also decreases. In this case, an amount of current supplied from the second transistor (M2) to the organic light emitting diode (OLED) is increased for a same data signal. That is to say, the amount of current supplied from the second transistor (M2) to the organic light emitting diode (OLED) increases as the organic light emitting diode (OLED) degrades according to an embodiment of the present invention. Therefore, the compensation circuit 144 compensates for a luminance drop caused by degradation of the organic light emitting diode (OLED).

While the present invention has been described in connection with certain exemplary embodiments, it is to be understood that the invention is not limited to the disclosed embodiments, but instead is intended to cover various modifications and equivalent arrangements included within the spirit and scope of the appended claims, and equivalents thereof.

What is claimed is:

1. A pixel, comprising:

an organic light emitting diode;

a second transistor coupled between a first power source and the organic light emitting diode for controlling an amount of current supplied from the first power source to the organic light emitting diode;

a third transistor coupled between a first electrode of the second transistor and the first power source, the third transistor configured to turn off when a light emission control signal is applied to a light emission control line coupled to a gate electrode of the third transistor;

a first transistor coupled between a gate electrode of the second transistor and a data line, the first transistor configured to turn on when a scan signal is applied to a scan line coupled to a gate electrode of the first transistor;

a first capacitor coupled between the gate electrode and the first electrode of the second transistor;

a second capacitor coupled between the first electrode of the second transistor and the first power source; and a compensation circuit coupled between the organic light emitting diode and the gate electrode of the second transistor, the compensation circuit for adjusting a voltage at the gate electrode of the second transistor in accordance with degradation of the organic light emitting diode.

2. The pixel according to claim 1, wherein a capacitance of the second capacitor is greater than a capacitance of the first capacitor.

3. The pixel according to claim 2, wherein the capacitance of the second capacitor is 2 to 10 times the capacitance of the first capacitor.

4. The pixel according to claim 1, wherein the compensation circuit comprises:

a third capacitor having a first terminal coupled to the gate electrode of the second transistor;

a fourth transistor coupled between a second terminal of the third capacitor and an anode electrode of the organic light emitting diode, the fourth transistor configured to turn on when the scan signal is applied to the scan line coupled to a gate electrode of the fourth transistor; and a fifth transistor coupled between the second terminal of the third capacitor and a reference power source, the fifth transistor configured to turn off when the light emission control signal is applied to the light emission control line coupled to a gate electrode of the fifth transistor.

5. The pixel according to claim 4, wherein a voltage of the reference power source is higher than a threshold voltage of the organic light emitting diode.

6. An organic light emitting display device, comprising:

a scan driver for applying scan signals to a plurality of scan lines and applying light emission control signals to a plurality of light emission control lines;

a data driver for supplying a reset power voltage and applying data signals to a plurality of data lines; and a plurality of pixels arranged at crossing regions of the plurality of data lines and the plurality of scan lines, each of the plurality of pixels comprising:

an organic light emitting diode;

a second transistor coupled between a first power source and the organic light emitting diode, the second transistor for controlling an amount of current supplied from the first power source to the organic light emitting diode;

a third transistor coupled between a first electrode of the second transistor and the first power source, the third transistor configured to turn off when a light emission control signal is applied to a corresponding light emission control line coupled to a gate electrode of the third transistor;

a first transistor coupled between a gate electrode of the second transistor and a corresponding data line, the first transistor configured to turn on when a scan signal is applied to a corresponding scan line coupled to a gate electrode of the first transistor;

a first capacitor coupled between the gate electrode and the first electrode of the second transistor;

a second capacitor coupled between the first electrode of the second transistor and the first power source; and a compensation circuit coupled between the organic light emitting diode and the gate electrode of the second transistor, the compensation circuit for adjusting a voltage at the gate electrode of the second transistor in accordance with degradation of the organic light emitting diode.

7. The organic light emitting display device according to claim 6, wherein a capacitance of the second capacitor is greater than a capacitance of the first capacitor.

8. The organic light emitting display device according to claim 7, wherein the capacitance of the second capacitor is 2 to 10 times the capacitance of the first capacitor.

9. The organic light emitting display device according to claim 6, wherein the scan driver is configured to apply a light emission control signal to an $i^{th}$ light emission control line during a second portion and a third portion of a period in which a scan signal is being applied to a corresponding $i^{th}$ scan line.

10. The organic light emitting display device according to claim 9, wherein the scan driver is configured to stop the application of the light emission control signal to the $i^{th}$ light emission control line after the application of the scan signal to the corresponding $i^{th}$ scan line is stopped.

11. The organic light emitting display device according to claim 9, wherein the data driver is configured to supply the reset power voltage to the plurality of data lines during a first portion and the second portion of the period, and configured to apply data signals to the plurality of data lines during the third portion of the period.

12. The organic light emitting display device according to claim 6, wherein the compensation circuit comprises:

a third capacitor having a first terminal coupled to the gate electrode of the second transistor;

a fourth transistor coupled between a second terminal of the third capacitor and an anode electrode of the organic light emitting diode, the fourth transistor configured to turn on when the scan signal is applied to the corresponding scan line coupled to a gate electrode of the fourth transistor; and a fifth transistor coupled between the second terminal of the third capacitor and a reference power source, the fifth transistor configured to turn off when the light emission control signal is applied to the corresponding light emission control line coupled to a gate electrode of the fifth transistor.

13. The organic light emitting display device according to claim 12, wherein a voltage of the reference power source is higher than a threshold voltage of the organic light emitting diode.

14. The organic light emitting display device according to claim 6, wherein the reset power voltage is higher than the data signal.

15. The organic light emitting display device according to claim 14, wherein the reset power voltage is lower than a voltage of the first power source.

* * * * *